United States Patent [19]

Shida et al.

[11] 4,437,769

[45] Mar. 20, 1984

[54] ELECTRONIC TIMEPIECE

[75] Inventors: Masaharu Shida; Makoto Ueda; Shuji Otawa; Masaaki Mandai; Katsuhiko Sato, all of Tokyo, Japan

[73] Assignee: Seiko Instruments & Electronics Ltd., Tokyo, Japan

[21] Appl. No.: 168,321

[22] Filed: Jul. 10, 1980

[30] Foreign Application Priority Data

Jul. 13, 1979 [JP] Japan ..... 54-89008

[51] Int. Cl.[3] ..... G04C 3/00

[52] U.S. Cl. ..... 368/204; 368/157; 368/217; 368/66; 340/636; 318/696; 323/299

[58] Field of Search ..... 368/204, 203, 66, 76, 368/85, 80, 86, 155, 87, 157, 217, 160, 218, 219, 228; 340/636; 318/696; 323/299

[56] References Cited

U.S. PATENT DOCUMENTS

| | | | |
|---|---|---|---|
| 4,107,595 | 8/1978 | Campe | 318/696 |
| 4,129,981 | 12/1978 | Nomura et al. | 368/204 X |
| 4,140,955 | 2/1979 | Drabing | 318/696 |
| 4,150,536 | 4/1979 | Nakajima et al. | 368/204 X |
| 4,212,156 | 7/1980 | Kawamura et al. | 368/217 X |
| 4,214,434 | 7/1980 | Sutter | 368/218 X |
| 4,230,970 | 10/1980 | Potter et al. | 323/299 X |
| 4,254,491 | 3/1981 | Haub et al. | 368/86 X |
| 4,272,837 | 6/1981 | Ueda et al. | 368/217 X |
| 4,281,405 | 7/1981 | Besson et al. | 368/80 X |
| 4,295,083 | 10/1981 | Leenhouts | 318/696 |
| 4,326,161 | 4/1982 | Kreinberg | 323/299 |
| 4,361,410 | 11/1982 | Nakajima et al. | 368/217 X |

*Primary Examiner*—B. A. Reynolds
*Assistant Examiner*—Philip H. Leung
*Attorney, Agent, or Firm*—Robert E. Burns; Emmanuel J. Lobato; Bruce L. Adams

[57] ABSTRACT

An electronic timepiece having a stepping motor includes a power source, an oscillating circuit, a dividing circuit connected to the oscillating circuit, and a wave shaping circuit receptive of a plurality of output signals produced from the dividing circuit to produce a plurality of controlling signals. A controlling circuit receives the controlling signals and controls a driving circuit. The power source is connected to a detecting voltage circuit by which the variation of the supply voltage of the power source is detected, and a normal waveform or an intermittent waveform is selectively applied to the stepping motor according to the variation of the supply voltage. As a result, the power consumption of the stepping motor is controlled at a constant level, even if the supply voltage of the power source is higher than the optimum voltage of the stepping motor and even if the supply voltage varies.

16 Claims, 26 Drawing Figures

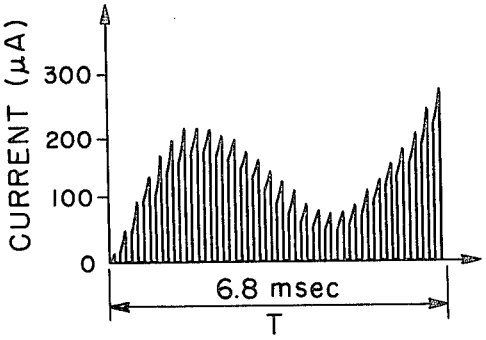
FIG. 6(b)
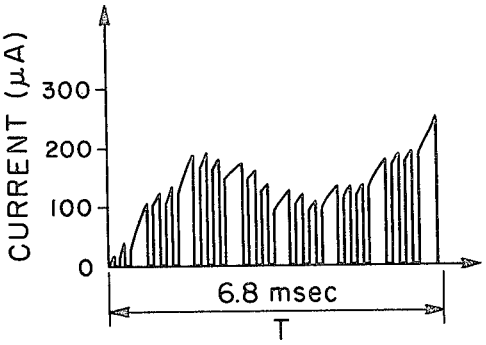
FIG. 6(c)
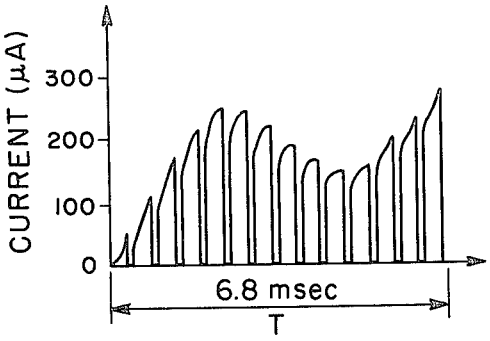
FIG. 6(d)
FIG. 6(e)
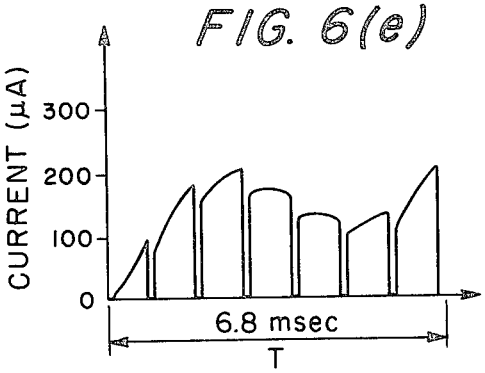
FIG. 6(a)
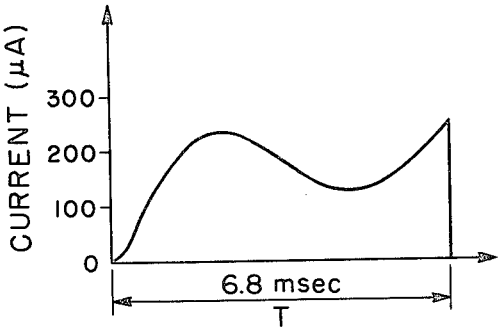
FIG. 6(f)
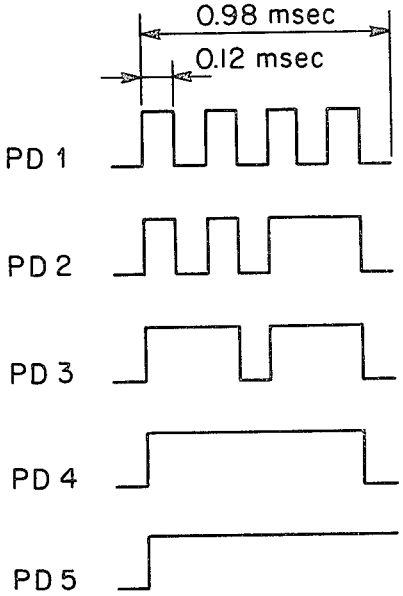

ELECTRONIC TIMEPIECE

BACKGROUND OF THE INVENTION

The present invention relates to an analogue display electronic timepiece using a stepping motor, and more particularly to an improvement for controlling the output and power consumption of the stepping motor at a constant level even if the supply voltage of a power source is higher than the optimum voltage and even if the supply voltage and the internal resistance of the power source vary.

Before describing the invention, a typical electronic timepiece using a stepping motor conventionally used will be illustrated.

FIG. 1 shows a block diagram of the conventional electronic timepiece. A quartz crystal resonator 1 is connected to an oscillating circuit 2 generates an oscillatory signal of 32768 Hz frequency. The oscillatory signal is fed to a frequency divider 3 and divided into one second signals by a flipflop comprised of 15 stages. Subsequently, a wave shaping circuit 4 composes driving pulse signals necessary for driving a stepping motor 6. A driving circuit 5 flows current in the stepping motor 6 according to the driving pulses produced from the wave shaping circuit 4.

FIG. 2(*a*) shows an overall perspective view of the stepping motor, where reference numeral 11 denotes a stator, 12 denotes a rotor and 13 denotes a coil. The construction of this stepping motor is the same as the stepping motor used in the embodiments of the present invention.

FIG. 2(*b*) shows a voltage waveform of the driving pulses applied across the coil 13 from the driving circuit 5. As shown, the driving pulses comprise alternate polarity pulses of one second period and having a pulse width of 6.8 msec.

All the circuits shown in FIG. 1 are fabricated as an IC and the power is supplied from a power source 7. The power source 7 is generally a silver battery which shows a plain discharging characteristic of 1.5 V up to nearly the end of the battery life and therefore the operations of the circuits and the stepping motor are stable. The supply voltage is easily detected by adding a battery life displaying device which detects the battery voltage at the end of the battery life when the supply voltage begins to drop. Therefore it is not necessary to take into account the voltage variation when designing the stepping motor.

On the other hand, in case a peroxide silver battery is used for the power source, since the supply voltage of the peroxide silver battery is 1.8 V just after it is manufactured, the operation of the stepping motor is unstable.

In order to eliminate the above mentioned defect, the battery capacity is reduced to 1.5 V by a silver treatment process during the manufacture of the peroxide silver battery. However, the feature of the peroxide silver battery, i.e., the feature that the battery capacity is large with respect to its volume, is not made the best use of.

Although a lithium battery is advantageous in view of its high reliability and high energy density, the discharging characteristic is exceedingly disadvantageous.

FIG. 3(*a*) shows the discharging characteristic of the lithium battery. As shown in FIG. 3(*a*), a voltage of 3 V in the beginning drops to 2.7 V after a fixed time and remains at 2.7 V for a while and thereafter the voltage reduces gradually. It is exceedingly difficult to drive the conventional stepping motor stably by the lithium battery having the above mentioned characteristics. Further, since the current and output torque are also influenced by the voltage, it is difficult to drive the stepping motor in the range of the variable voltage exhibited by the lithium battery. Furthermore, in the case that the stepping motor for 3 V is used with the conventional power, it is necessary to wind the motor coil with a thin wire in order to increase the coil resistance and this results in an increased manufacturing cost.

FIG. 3(*b*) shows a variation of the supply voltage in the case that a silver battery or peroxide battery is used as a secondary battery and charged by a solar battery. In this case the supply voltage constantly varies between 1.57 V and 1.8 V by repetition of charging and discharging. And since the performance of the stepping motor becomes unstable as described above, a controlling method as shown in block form in FIG. 4 has been devised.

FIG. 4 is a block diagram showing a supply voltage detecting circuit 9 and a controlling circuit 8 which varies the pulse width of the driving pulses according to the voltage variation in order to shorten the driving pulse width in the case the supply voltage is high. In other respects, the circuitry is like that shown in FIG. 1.

Several characteristics of the stepping motor versus voltage in the case where the driving pulse width is varied are shown in FIGS. 5(*a*), 5(*b*), 5(*c*) and 5(*d*).

FIGS. 5(*a*), 5(*b*), 5(*c*) and 5(*d*) respectively show a mean current, an output torque at a center wheel and pinion, an efficiency and a peak current value versus the voltage.

However, in this prior art method of varying the driving pulse width of the stepping motor, there is an operating range where the operation of the stepping motor is unstable by the combination of a specific voltage and pulse width as shown in FIGS. 5(*a*) and 5(*b*) (in this embodiment from about 2.3 to 2.7 V), and the desired output torque cannot be obtained in this voltage range. While the efficiency decreases in accordance with the voltage as shown in FIG. 5(*c*) and the peak current increases in accordance with the voltage as shown in FIG. 5(*d*), the design of the power source battery and the IC are restricted. Thus there are a number of drawbacks in the conventional driving method for a practical use.

SUMMARY OF THE INVENTION

It is an object of the present invention to provide a power controlling system which operates stably by overcoming the above mentioned drawbacks conventional timepieces constructions.

BRIEF DESCRIPTION OF DRAWINGS

These and other objects, features and advantages of the invention will become more apparent upon a reading of the following detailed specification and drawing, in which.

Figure 1:
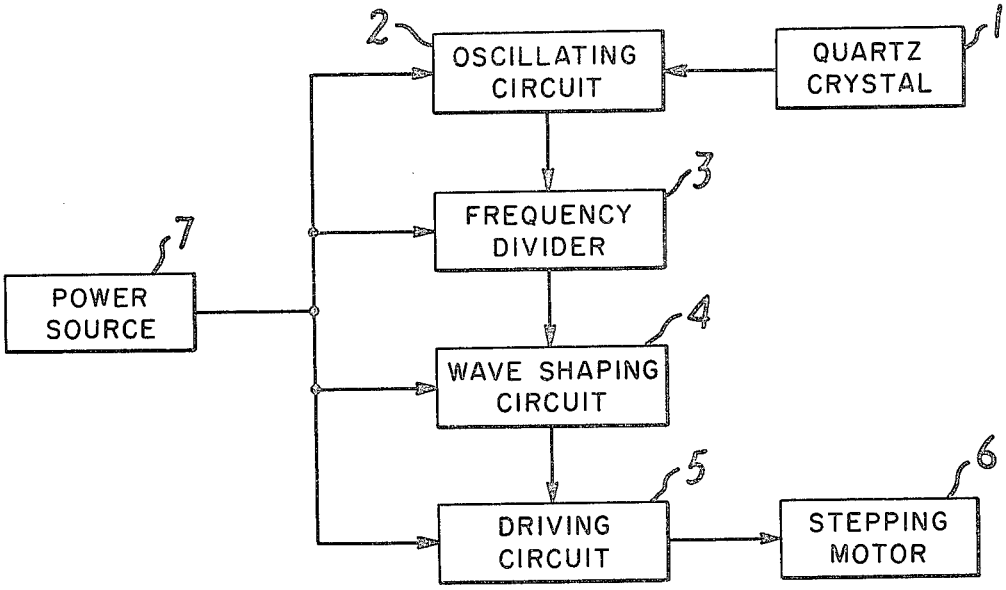
FIG. 1 PRIOR ART
FIG. 1 is a block diagram of the conventional electronic timepiece.
Figure 2A:
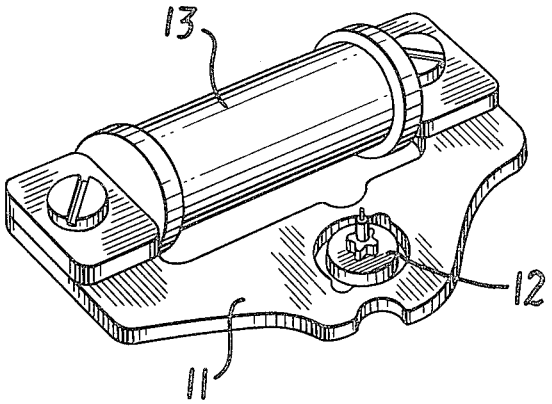
FIG. 2(a) PRIOR ART
FIGS. 2(*a*) and 2(*b*) respectively show a perspective view of the embodiment of the stepping motor and the embodiment of the driving voltage waveform, FIG. 3(*a*) is a graph showing the discharging characteristic of the lithium battery, FIG. 3(*b*) shows the variation of the charging-discharging characteristic of the secondary battery.
Figure 2B:
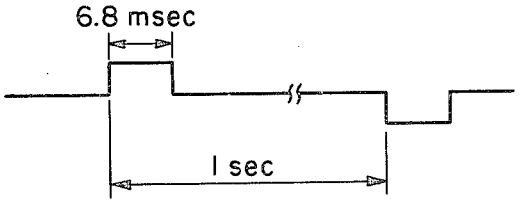
FIG. 2(b) PRIOR ART
Figure 3A:
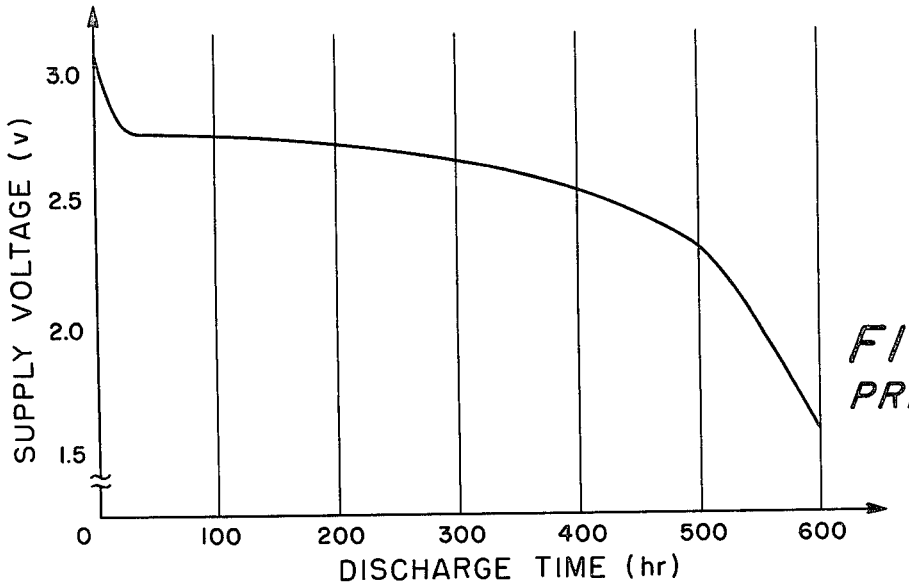
FIG. 3(a) PRIOR ART
Figure 3B:
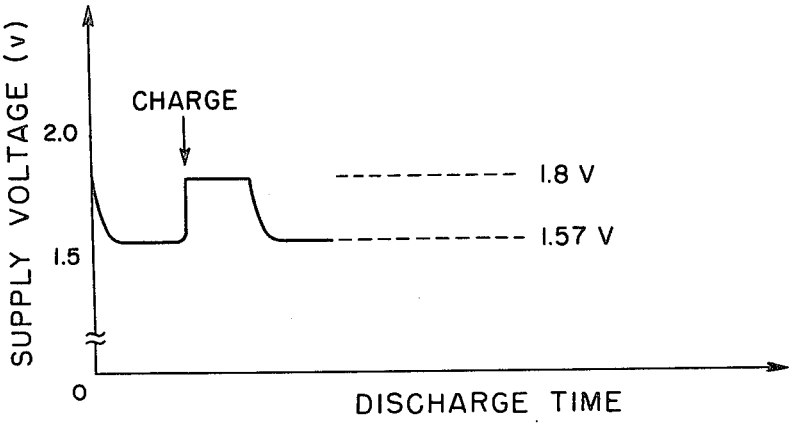
FIG. 3(b) PRIOR ART
Figure 4:
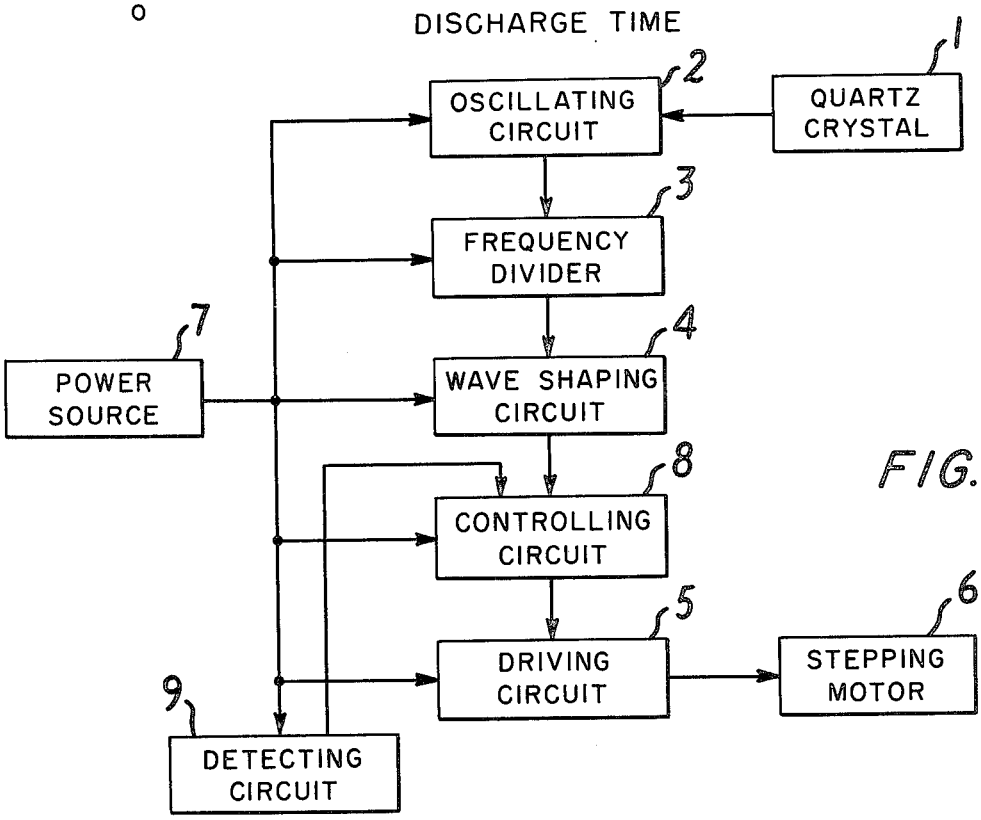
FIG. 4 is a block diagram of an electronic timepiece according to the present invention, FIGS. 5(*a*), 5(*b*), 5(*c*) and 5(*d*) are diagrams of stepping motor characteristics versus voltage according to the conventional driving method, FIG. 6(*a*) shows the driving voltage waveforms according to the present invention, FIGS. 6(*b*), 6(*c*), 6(*d*), 6(*e*) and 6(*f*) are embodiments of the current waveform, FIGS. 7(*a*), 7(*b*), 7(*c*) and 7(*d*) are characteristic diagrams of the stepping motor versus voltage according to the driving method of the present invention, FIGS. 8(*a*), 8(*b*) and 8(*c*) are the embodiments of the voltage detecting circuit according to the present invention.
Figure 5A:
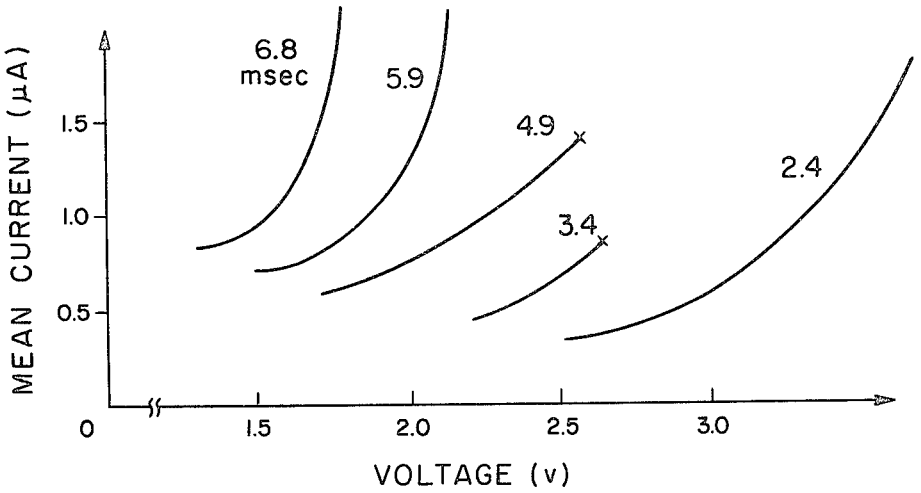
FIG. 5(a) PRIOR ART
Figure 5B:
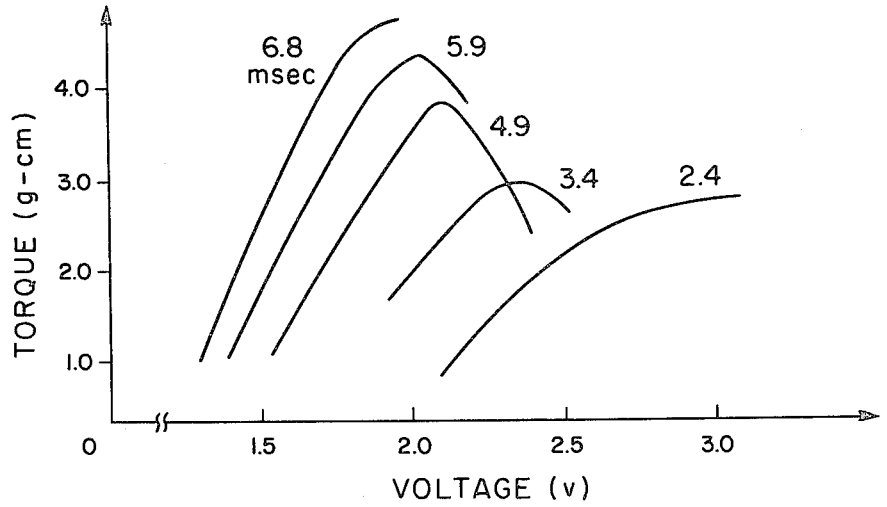
FIG. 5(b) PRIOR ART
Figure 5C:
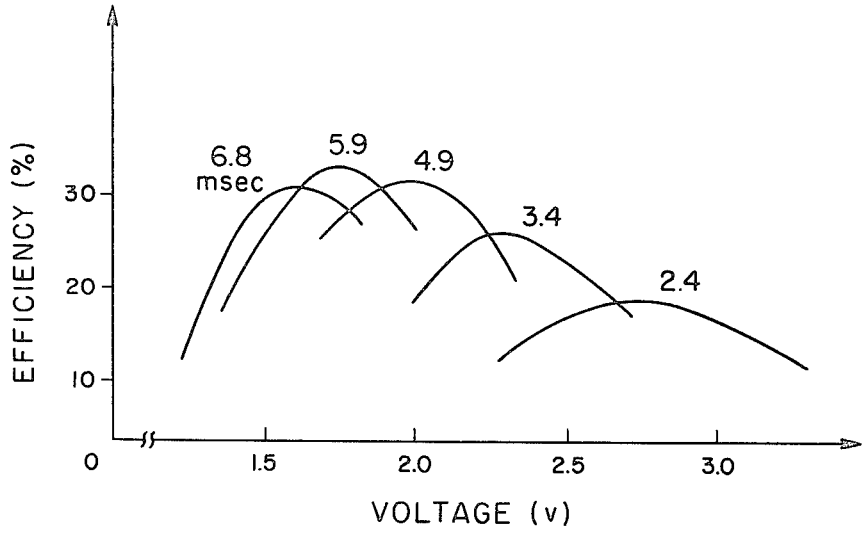
FIG. 5(c) PRIOR ART
Figure 5D:
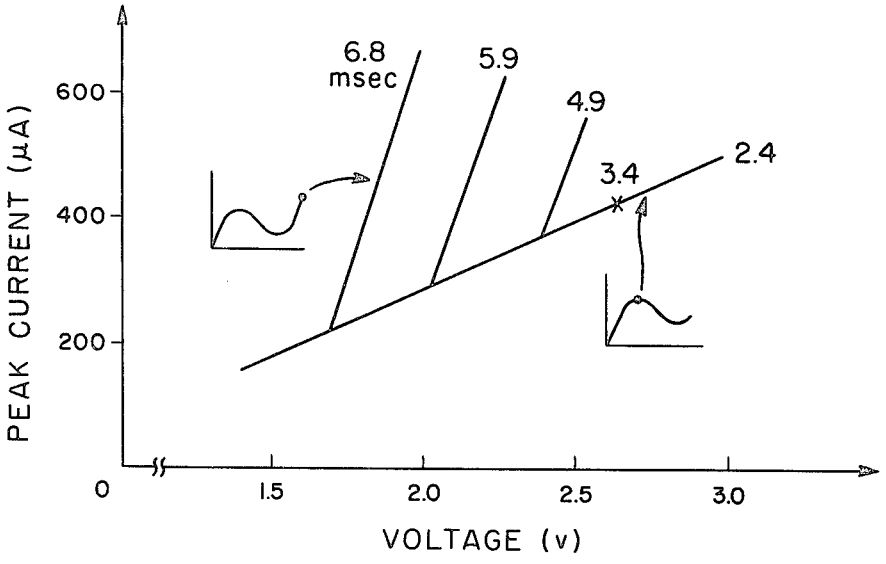
FIG. 5(d) PRIOR ART
Figure 7A:
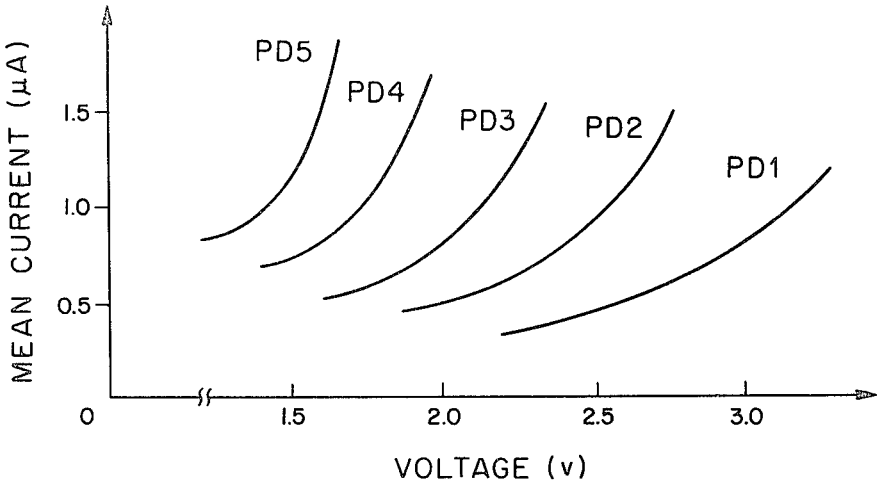
Figure 7B:
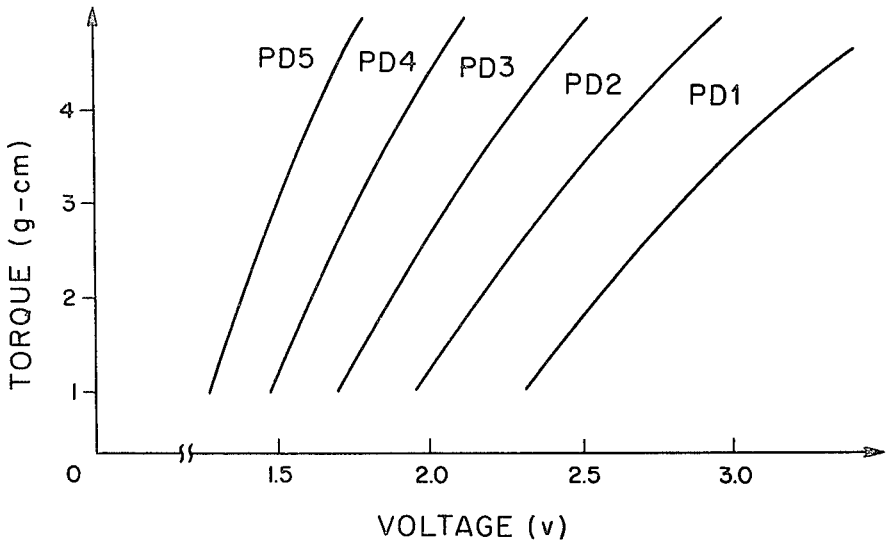
Figure 7C:
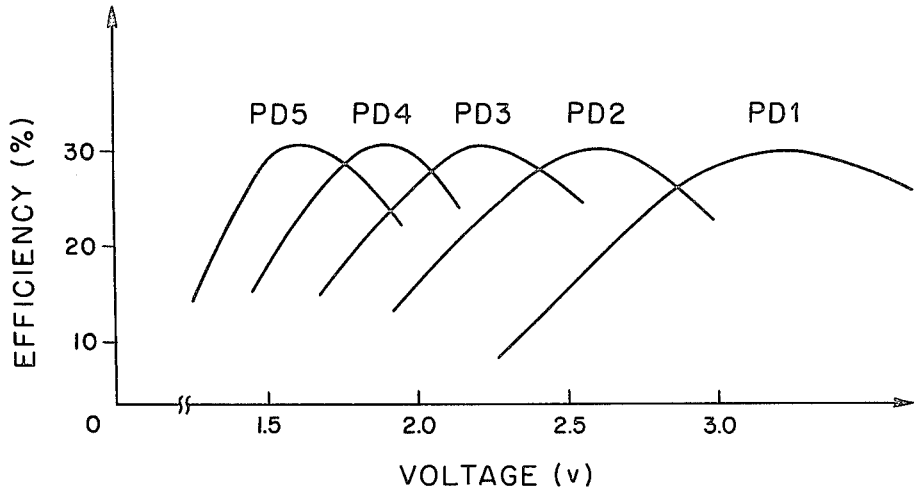
Figure 7D:
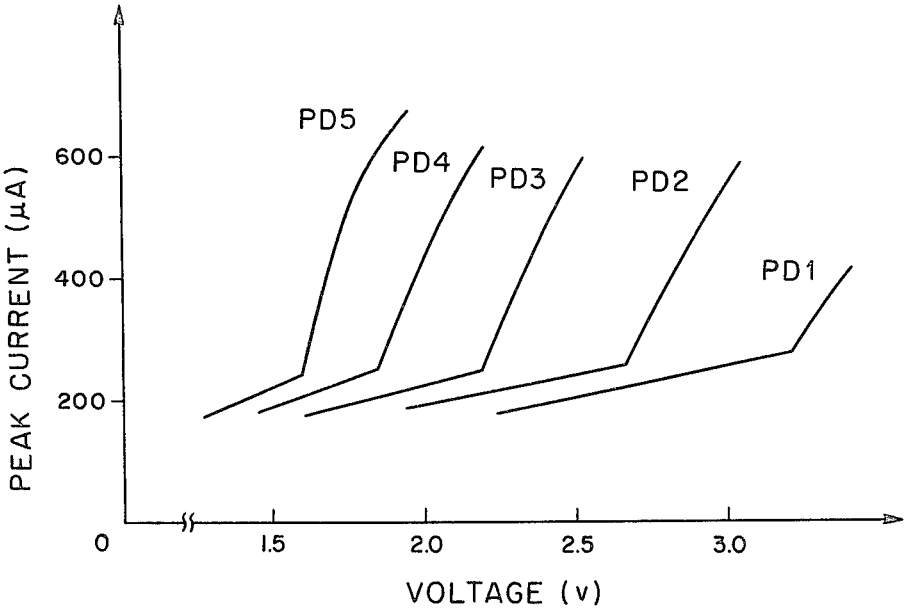

DETAILED DESCRIPTION OF THE INVENTION:

The block diagram shown in FIG. 4 according to the present invention is the same as the prior art block diagram shown in FIG. 1 except for detailed the wave shaping circuit 4, the controlling circuit 8, the detecting circuit 9 and the driving circuit 5 which will be described hereinafter.

Referring first to FIG. 6(*a*), there is shown an embodiment of a repeating pulse pattern of the driving pulse having voltage waveforms according to the present invention. By repeating these waveforms seven times, the driving pulse width is 6.8 msec as a whole. If the driving pulse has some portions where the driving voltage is at 0 (V) on the basis of 0.12 msec pulse width as one unit, the duty cycle or rate of the effective driving pulse widths (effective rates) vary at 4/8, $\frac{5}{8}$, 6/8, $\frac{7}{8}$, and 8/8 from $PD_1$ to $PD_5$ respectively.

FIGS. 6(*b*), 6(*c*), 6(*d*), 6(*e*) and 6(*f*) respectively show current waveforms in case the stepping motor is driven by driving pulses having repeating voltage waveforms $PD_1$, $PD_2$, $PD_3$, $PD_4$and $PD_5$ when the supply voltages are 3.2 (V), 2.7 (V), 2.2 (V), 1.8 (V) and 1.6 (V). These FIGS. show that an envelope of current waveforms are kept substantially constant in all of the cases.

The current waveforms are kept substantially the same according to the following explanation. The current waveforms in FIG. 6(*a*), 6(*b*), 6(*c*), 6(*d*), 6(*e*) and 6(*f*) show the current flowing from the power source and thus the current value where the driving voltage is eliminated is "0". But current keeps flowing in the coil of the stepping motor due to the inductance of the coil the current flow through a closed loop including the driving circuit. The driving power applied to the rotor of the stepping motor is therefore averaged by the above mode of operation. Accordingly, if a part of the driving pulse is eliminated at an appropriate effective value in the case the supply voltage is high, the driving power the same as the driving power that the stepping motor is driven by the non-eliminated driving pulse can be applied to the rotor by a lower supply voltage.

In the case of FIGS. 6(*b*), (*c*), (*d*), (*e*) and (*f*), since the condition is chosen so that the value multiplying the supply voltage by the effective rate of the driving pulse is substantially constant, the movement of the rotor is almost the same. Accordingly the current waveforms are almost the same.

The widths of intermittence of the driving pulses are determined in accordance with the desired standardization of the driving electric power and the driving power of the rotor. The shorter the width of intermittence of the driving pulse, the more the driving electric power and the driving power of the rotor are averaged in comparison with the time constant determined by the inductance and resistance of the coil.

FIGS. 7(*a*), (*b*), (*c*) and (*d*) show stepping motor characteristics versus voltage when the stepping motor is driven by the above driving voltage waveforms. FIGS. 7(*a*), (*b*), (*c*) and (*d*) respectively show a mean current, an output torque at a center wheel and pinion, an efficiency and a peak current of the stepping motor versus voltage. The system of the present invention enables the stepping motor to operate stably over a wide range of supply voltages. If the driving voltage waveforms from $PD_1$ to $PD_5$ are changed over to an optimum voltage, the power consumption, output torque and efficiency are kept substantially at in constant level and the peak current can be kept within a substantially constant value as shown in FIG. 7(*d*).

Hereinafter each circuit block of the electronic timepiece according to the present invention will be illustrated in detail.

Figure 8A:
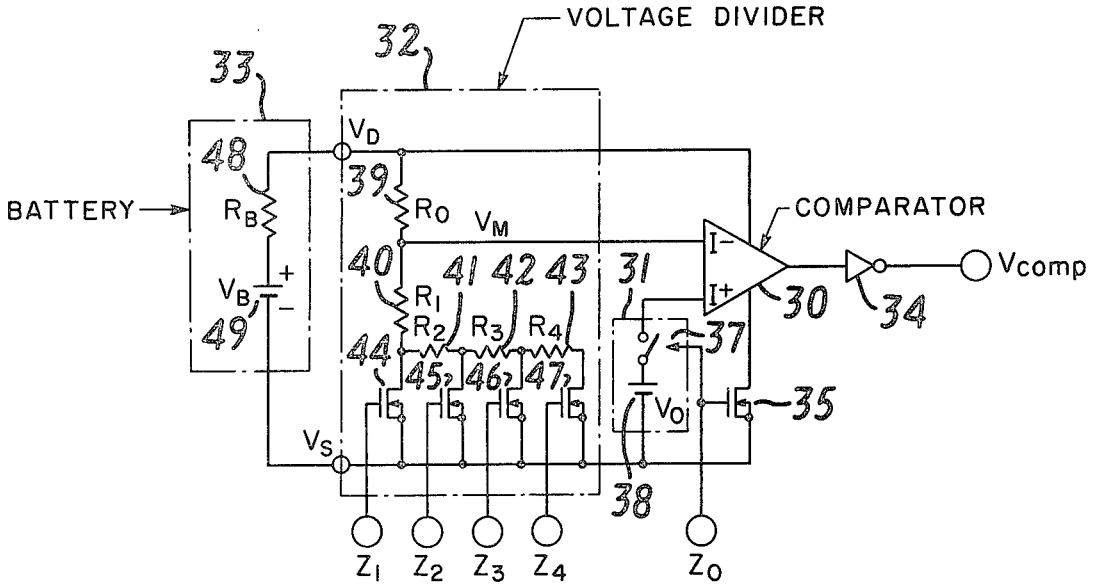
Figure 8B:
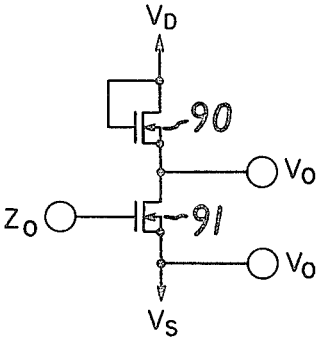
Figure 8C:
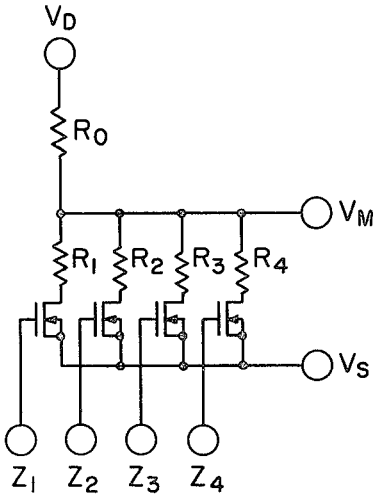

FIG. 8(*a*) is a schematic diagram of the voltage detecting circuit 9 and the power source 7 according to the present invention. Reference numeral 33 denotes a battery, 49 denotes an ideal battery which produces a battery voltage $V_B$, 48 is a resistor representing the internal resistance of the battery. Terminals $V_D$, $V_S$ are terminals of an IC. In FIG. 8(*a*) the portion except the battery 33 is the voltage detecting circuit incorporated into the IC.

The voltage detecting circuit comprises of three blocks, i.e., a comparator 30, a reference voltage generator 31 and a voltage divider 32. The comparator 30 compares the voltages of an input $I^+$ and an input $I^-$ and the output from the comparator 30 is "H" when $I^+ > I^-$. An inverter 34 serves as a buffer of the comparator and at the same time reverses the comparator output. The output from the inverter is Vcomp.

Generally, since the comparator consumes power when it operates, NMOS FET is ON only when the $Z_O$ signal is "H".

The reference voltage generator 31 can be regarded as the equivalent of a battery having a voltage $V_O$. Since an operating current is also necessary for generating the reference voltage, the generator 31 can be regarded as having a switch 37 which is ON and the reference voltage generator 31 operates when the $Z_O$ signal is "H".

The reference voltage generator 31 has conventionally been developed for detecting battery life. The battery life is detected using the difference in threshold voltage between a couple of NMOS FETs. FIG. 8(*b*) shows an embodiment of the voltage detecting circuit construction.

NMOS FET 91 has a threshold voltage $V_{TN}$. NMOS FET 90 is controlled by ion implantation to have a threshold voltage $V'_{TN}$ and the output $V_O$ is given by $V_O = V_{TN} - V'_{TN}$. Although the absolute values of $V_{TN}$ and $V'_{TN}$ vary according to the density of the substrate, temperature and the like, the value $V_{TN} - V'_{TN}$ can be controlled by the amount of the ion implantation in the IC during the manufacturing process. The switch 37 may operate if the control signal $Z_O$ is applied to the gate of NMOS FET 91.

The operation of the voltage divider 32 of the power source will now be described.

If the terminal $Z_1$ is "H", NMOS FET 44 is ON. When $R_B=0$ and the ON resistance of NMOS FET 44 is 0, $V_M=V_B \cdot R_1/(R_0+R_1)$. The comparator 30 compares voltages between $V_M$ and $V_O$ and judges the higher one.

In the case the driving voltage varies, ratios of $R_0$, $R_1$, $R_2$, $R_3$ and $R_4$ can be determined by the following equations when the voltages to be detected are 2.8 V, 2.2 V, 1.9 V and 1.6 V.

$$V_{D1}=2.8=(1+R_0/R_1)V_0$$

$$V_{D2}=2.2=\{1+R_0/(R_1+R_2)\}V_0$$

$$V_{D3}=1.9=\{1+R_0/(R_1+R_2+R_3)\}V_0$$

$$V_{D4}=1.6=\{1+R_0/(R_1+R_2+R_3+R_4)\}V_0$$

In the above equations, $V_0$ can be regarded as a constant value as mentioned above and the resistance ratios of each equation can be set by length ratios of IC patterns. Therefore the temperature characteristic of the detecting voltages $V_{D1}$ to $V_{D4}$ is excellent and the resistance ratios of each equation are not influenced by parameters on the IC manufacturing process, and as a result, $V_D$ values of each equation can be set correctly.

FIG. 8(*c*) shows another embodiment of the voltage divider which is connected to the power source.. The voltage divider of FIG. 8(*c*) is the same as the voltage divider in FIG. 8(*a*) in operation but different from it in the setting method of the resistance.

Figure 9A:
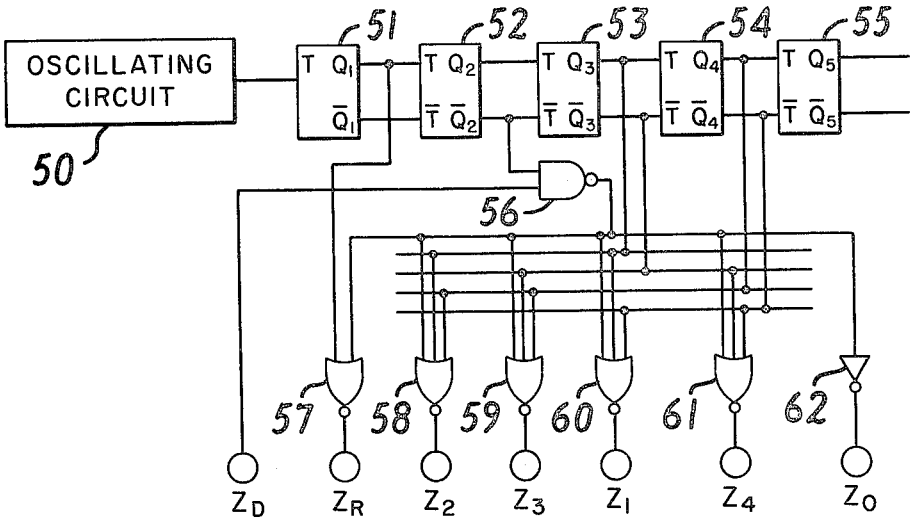
FIGS.9(*a*) and 9(*b*) show embodiments of the wave shaping circuit and the timing chart thereof.
Figure 9B:
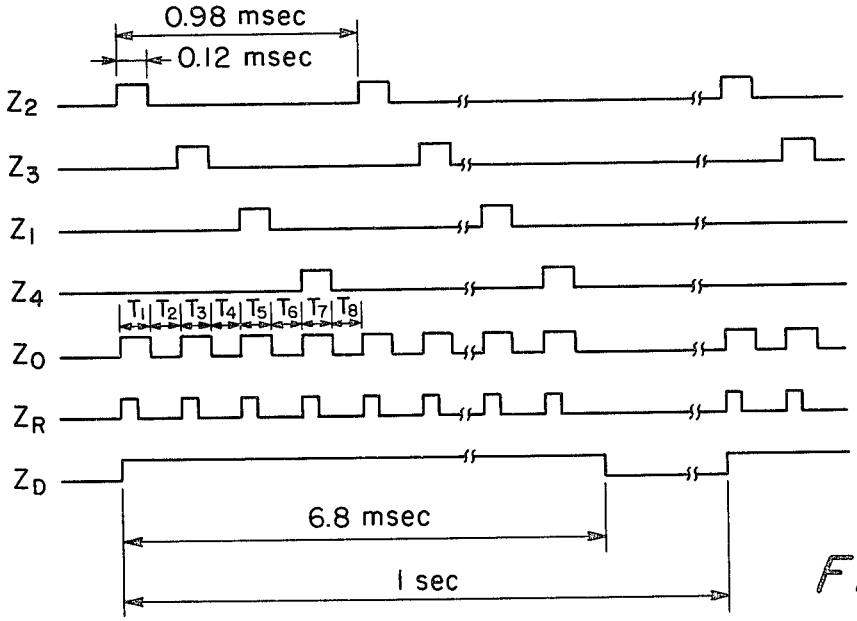

FIGS. 9(*a*) and (*b*) shows an embodiment of the construction of the wave shaping circuit 4 to compose the signals necessary for operating the controlling circuit 8 and the detecting circuit 9 and a timing chart thereof according to an embodiment of the present invention. An oscillating circuit 50 produces high frequency reference signals of 32768 Hz using a quartz crystal resonator as an oscillating source. The reference signals are divided in turn by flipflops 51, 52, 53, 54 and 55. The divided signals are composed by gates 56, 57, 58, 59, 60, 61 and 62 and the necessary control signals are produced. A signal of 1 second period having the pulse width of 6.8 msec is composed in other wave shaping circuitry (not shown) and is fed to an input terminal $Z_D$.

Signals composed in the wave shaping circuit 4 are 4 phases clock signals $Z_1$, $Z_2$, $Z_3$ and $Z_4$, 8 KHz signal $Z_0$ and 8 KHz signal $Z_R$ having a duty cycle of 1:3. All of these signals are masked by $Z_D$ signals having the pulse width of 6.8 msec at 1 second period.

Figure 10:
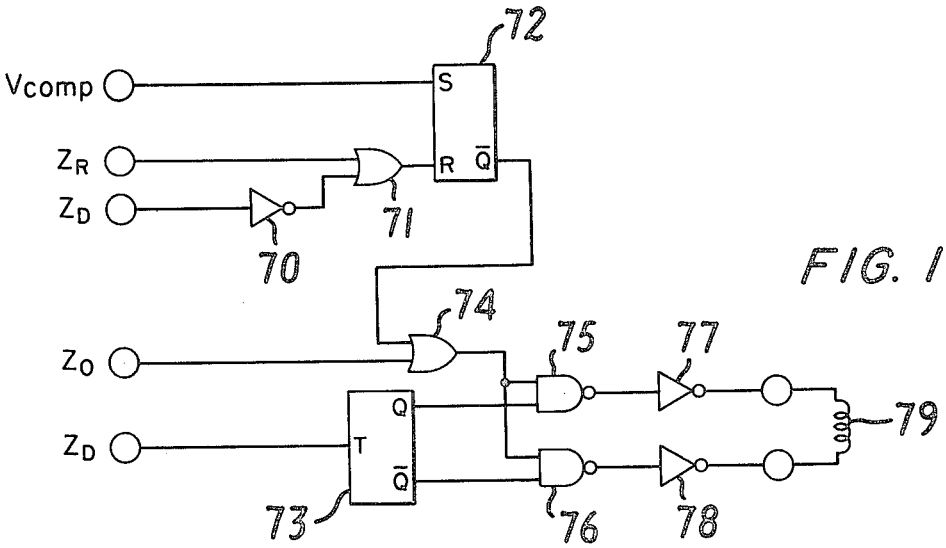
FIG. 10 shows the construction of the controlling circuit and the driving circuit.

FIG. 10 shows an embodiment of the construction of the controlling circuit 8 and the driving circuit 5. SR flipflop (flipflop is referred to as a FF hereafter) 72 latches the output Vcomp of the detecting circuit 9. TFF 73 inverts the outputs alternately by the $Z_D$ signals fed each one second and produces driving voltage waveforms produced from OR gate 74 to inverters 77 and 78 via NAND gates 75 and 76 alternately so as to excite a coil 79 of the stepping motor.

Now the overall operation of the present embodiment will be illustrated. The driving voltage waveform is initially H by the driving signals $Z_0$ at a timing $T_1$ in FIG. 9(*b*) and simultaneously the voltage detection is actuated by the $Z_2$ signal. FF 72 is previously reset by the $Z_R$ signal. Since Vcomp is H when the supply voltage is more than 2.2 V, FF 72 is set. As a result, the driving voltage waveform is L at more than 2.2 V supply voltage and H at less than 2.2 V supply voltage at a timing $T_2$. Likewise the driving signals $Z_0$ are produced at timings of $T_3$, $T_5$ and $T_7$ and the supply voltage is detected in the same way. And the driving voltage waveform at the next timing is L when the supply voltages are more than 1.9 V, 2.8 V and 1.6 V, and H when less than 1.9 V, 2.8 V and 1.6 V. As a result, the driving voltage waveforms at supply voltages over 2.8 V, 2.2 V, 1.9 V and 1.6 V and under 1.6 V are as shown by $PD_1$, $PD_2$, $PD_3$, $PD_4$ and $PD_5$ in FIG. 6(*a*) in 0.98 msec. The output operation for the 6.8 msec driving pulse is completed by repeating the above mentioned operation seven times.

The present invention enables the stepping motor driven by a 1.5 V battery to operate with a constant output, a constant power consumption and a constant efficiency in an operable range several times higher than in the conventional type. Although the effective rates, i.e., duty cycle, of the driving voltages against the overall pulse width vary at 4/8, $\frac{5}{8}$, 6/8, $\frac{7}{8}$ and 8/8 by detecting the driving voltages at four levels in this embodiment, the stepping motor can be driven up to higher voltages at constant conditions by varying the effective rates at $\frac{1}{8}$, 2/8, $\frac{3}{8}$ . . . On the other hand, although the conventional stepping motor for 1.5 V battery has been illustrated with respect to a 3 V battery such as a lithium battery, the detecting voltage levels and the kinds of the effective rates of the driving voltage waveforms may be reduced since the variation range of the battery voltage of the conventional silver oxide battery is 0.2 to 0.3 V. Thus the present invention is advantageous in that the stepping motor is driven at a constant output and a constant efficiency automatically in accordance with the variable battery voltages by the optimum combination of the setting value of the voltage detecting levels and the effective rates of the driving pulses.

Moreover, the present invention is effective even when the driving condition varies by an increase in the internal resistance of the battery, since the voltage levels of the stepping motor while being driven is detected. The current flow for driving the stepping motor causes the voltage to drop by a product of the current value and the internal resistance of the battery, and an increase in the voltage drop causes the large effective rate and a decrease in a voltage drop causes the small effective rate. Therefore the driving power of the motor is constant regardless of the internal resistance. Accordingly, the torque at low temperature, which is the worst condition for the timepiece, is reduced and the timepiece can be designed to reduce the driving power. As a result, the torque at room temperature is also reduced and the current is reduced simultaneously.

Since the motor can be driven at constant conditions against the variation of the internal resistance of the battery, the timepiece withstand capability at low temperature is realized by applying the present invention to the stepping motor driven by the silver battery of 1.5 V.

According to the present invention, the voltage detecting operation and the driving voltage controlling operation at 4 levels are actuated at a period of 0.98 msec. And seven cycles of the voltage detecting operation and the driving voltage controlling operation are detected in the driving pulse of 6.8 msec.

One unit of the intermittent period of the driving voltage waveform, 0.12 msec, is considerably short in comparison with the overall driving pulse of 6.8 msec. This intermittent period is determined by the time constant decided by the coil inductance and the DC resistance. By intermitting the driving voltage waveform by a shorter unit than the time constant, the zero current flow in a coil during the interrupted period is avoided. As the result, the above mentioned effect is realized.

Although the detecting voltage and the reference voltage are compared in the disclosed order of 2.2 V→1.9 V→2.8 V→1.6 V in the embodiment, it is noted that the order can be changed freely. Moreover, though the stepping motor according to the present invention is the bipolar one-piece stator type conventionally used in the an electronic wristwatch, the present invention may be applied to any type stepping motors such as a multipclar stepping motor, a single-face stepping motor, a two-pieces stator type stepping motor and a stepping motor for clocks.

We claim:

1. An electronic timepiece comprising: a power source; a quartz crystal oscillating circuit for generating a high frequency output signal; a dividing circuit connected to receive the high frequency output signal and operative to frequency divide the output signal into predetermined lower frequency signals; a wave shaping circuit connected to receive a plurality of lower frequency signals from the dividing circuit for producing a plurality of control signals; a controlling circuit connected to receive the control signals from the wave shaping circuit for controlling a driving circuit to produce a driving signal having an intermittent signal portion having one signal component effective when applied to the coil of the stepping motor for flowing driving current from the power source through the coil and another signal component effective to connect one terminal of the coil to the other terminal thereof so as not to make the driving current zero; a stepping motor connected to receive the drive signal from the driving circuit; and a detecting circuit for detecting the voltage output of the power source and operative to change the duty ratio of the intermittent signal portion in response to the detected output.

2. An electronic timepiece as claimed in claim 1; wherein the power source comprises a lithium battery.

3. An electronic timepiece as claimed in claim 1; wherein the power source is provided with a charging device.

4. An electronic timepiece as claimed in claim 1; wherein the period during which one terminal of the coil is connected to the other terminal of the coil is shorter than the time constant determined by the inductance of the coil and the resistance of the coil.

5. An electronic timepiece claimed in claim 1; wherein the detecting circuit includes means for detecting the supply voltage of the power source while the coil of the stepping motor receives the driving signal.

6. An electronic timepiece as claimed in claim 5; wherein the detection operation of the detecting circuit and the composite operation of making the driving signal are performed more than two times to produce one driving signal applied to the stepping motor.

7. An electronic timepiece as claimed in claim 1; wherein the duty ratio of the intermittent signal varies in the range of 1 to 0.1.

8. In an electronic timepiece having a stepping motor comprised of a stator, rotor and coil and powered during use by a power supply which exhibits variations in its output voltage: voltage detecting means for periodically detecting the output voltage of the power supply and producing a plurality of detection output signals each corresponding to a different predetermined detected voltage level; and circuit means for generating a plurality of different driving pulses each having a different duty cycle and responsive to the detection output signals for periodically applying to the motor coil selected ones of the driving pulses so as to rotationally drive the motor in a stepwise manner using driving pulses of optimum duty cycle which are selected according to the detected voltage level.

9. An electronic timepiece according to claim 8; wherein the circuit means comprises means for generating a plurality of different driving pulses comprised of different repeating pulse patterns having different duty cycles.

10. An electronic timepiece according to claim 9; wherein at least some of the repeating pulse patterns comprise intermittent pulse portions separated by constant time intevvals, the intermittent pulse portions being different for each different repeating pulse pattern and the constant time interval being the same for all of the different repeating pulse patterns.

11. An electronic timepiece according to claim 10; wherein the constant time interval is shorter than the time constant of the motor coil as determined by the coil inductance and the coil resistance.

12. An electronic timepiece according to claim 10; wherein the circuit means includes means for short-circuiting the motor coil during the periods of the constant time intervals of the driving pulses applied to the motor coil.

13. An electronic timepiece according to claim 8; wherein the voltage detecting means includes means for periodically detecting the output voltage of the power supply during the time that driving pulses are being applied to the motor coil.

14. An electronic timepiece according to claim 8; wherein the different duty cycles of the driving pulses vary in the range of 1 to 0.1.

15. An electronic timepiece according to claim 8; wherein the power supply comprises a lithium battery.

16. An electronic timepiece according to claim 8; wherein the circuit means includes control means for controlling which of the different driving pulses are applied to the motor coil in dependence on which of the different detected voltage levels are detected by the voltage detecting means.

* * * * *